US005158399A

United States Patent [19]

Flores

[11] Patent Number: 5,158,399

[45] Date of Patent: Oct. 27, 1992

[54] METHOD FOR ERECTING A BELOW GRADE WALL

[76] Inventor: Raymond H. Flores, 2268 Lagoon View Dr., Cardiff by the Sea, Calif. 92007

[21] Appl. No.: 813,684

[22] Filed: Dec. 27, 1991

[51] Int. Cl.[5] ..... E02D 29/02

[52] U.S. Cl. ..... 405/285; 405/50; 405/262; 405/287

[58] Field of Search ..... 405/262, 267, 272, 282, 405/284, 285, 286, 287, 50

[56] References Cited

U.S. PATENT DOCUMENTS

| | | | |
|---|---|---|---|
| 3,254,490 | 6/1966 | Moore | 405/285 |
| 3,381,483 | 5/1968 | Huthsing | 405/285 X |
| 3,530,676 | 9/1970 | York | 405/285 |
| 4,718,792 | 1/1988 | Louis | 405/262 |
| 4,848,972 | 7/1989 | Trevisani | 405/262 |
| 4,911,582 | 3/1990 | Peirce et al. | 405/262 |
| 4,911,583 | 3/1990 | Carey | 405/262 |
| 4,929,125 | 5/1990 | Hilfiker | 405/262 |

*Primary Examiner*—David H. Corbin
*Attorney, Agent, or Firm*—Frank D. Gilliam

[57] ABSTRACT

A method of progressively erecting a wall below earth grade as excavation of the volume to be walled is accomplished. Initially, a plurality of spaced, generally vertical, holes are drilled in the earth to the full intended wall height along edges of the intended excavation plus an embediment amount at the lower end. Parallel soilpier beams are secured in each hole, preferably by filling the hole around each soilpier beam with lean concrete. The interior area is incrementally excavated, including the earth between the soilpier beams, to a selected depth. After the lean concrete on at least the sides of the soilpier beams in line with other soilpier beams is chipped away to the selected incremental excavated depth, structural panels having heights substantially corresponding to the excavated depth are placed between the soilpier beams and secured to the soilpier beams. Incremental excavation is continued and panels are installed in series until the desired full depth is reached. Preferably, the soilpier beams are metal and the panels are structural concrete with metal strips secured vertically near the panel edges, so that the panels can be secured to the soilpier beams by welding brackets between soilpier beams and strips. Pins may be provided between abutting edges of adjacent panels. Concrete grout may be introduced into spaces between panels and soilpier beams and between panels and the surrounding earth to further strengthen the structure.

17 Claims, 2 Drawing Sheets

METHOD FOR ERECTING A BELOW GRADE WALL

BACKGROUND OF THE INVENTION

This invention relates in general to methods of building walls and, more specifically, to methods of progressively assembling high strength walls below grade as an excavation progressively is deepened.

Buildings often include basements or other subterranean excavations to provide foundations for large buildings, parking garages, storage space or the like. Generally, the earth is removed from the excavation while the surrounding earth is prevented from caving in by temporary restraining walls against which permanent concrete walls constructed. In many cases, only after the entire depth is reached are permanent walls constructed around the excavation. These walls are often formed by constructing forms and pouring concrete into the forms. Often these walls are very tall and considerable danger exists while constructing the temporary retaining walls, forms are constructed and the pours of very heavy wet concrete are made. Also, the expense of very tall forms and retaining walls is considerable.

Thus, there is a continuing need for methods of constructing walls around excavations which are less complex and expensive, and provide greater safety during construction.

SUMMARY OF THE INVENTION

It is, therefore, an object of this invention to provide a method for constructing below-grade retaining walls of improved convenience and safety. Another object is to provide such a wall construction method in which the wall is constructed progressively as excavation depth increases. Still another object is to provide such a wall construction method providing a wall of increased strength at lower construction cost.

The above-noted objects, and others, are accomplished in accordance with this invention by a method which basically includes the steps of boring a plurality of substantially parallel, usually vertical, holes along the path of the intended wall, installing soilpier beams in those holes, preferably by surrounding them with lean concrete filling the space between soilpier beam and hole, excavating the earth to a selected depth, chipping away the lean concrete at least on the sides of the soilpier beams in line with the other soilpier beams to that depth, securing a plurality of panels, typically reinforced concrete panels, between adjacent soilpier beams and continuing these steps with further excavation until the full excavation depth is reached. Footings, floors, drain systems and the like may be installed when the excavation is fully excavated.

BRIEF DESCRIPTION OF THE DRAWING

Details of the invention, and of certain preferred embodiments thereof, will be further understood upon reference to the drawing, wherein.

DETAILED DESCRIPTION OF PREFERRED EMBODIMENTS

Figure 1:
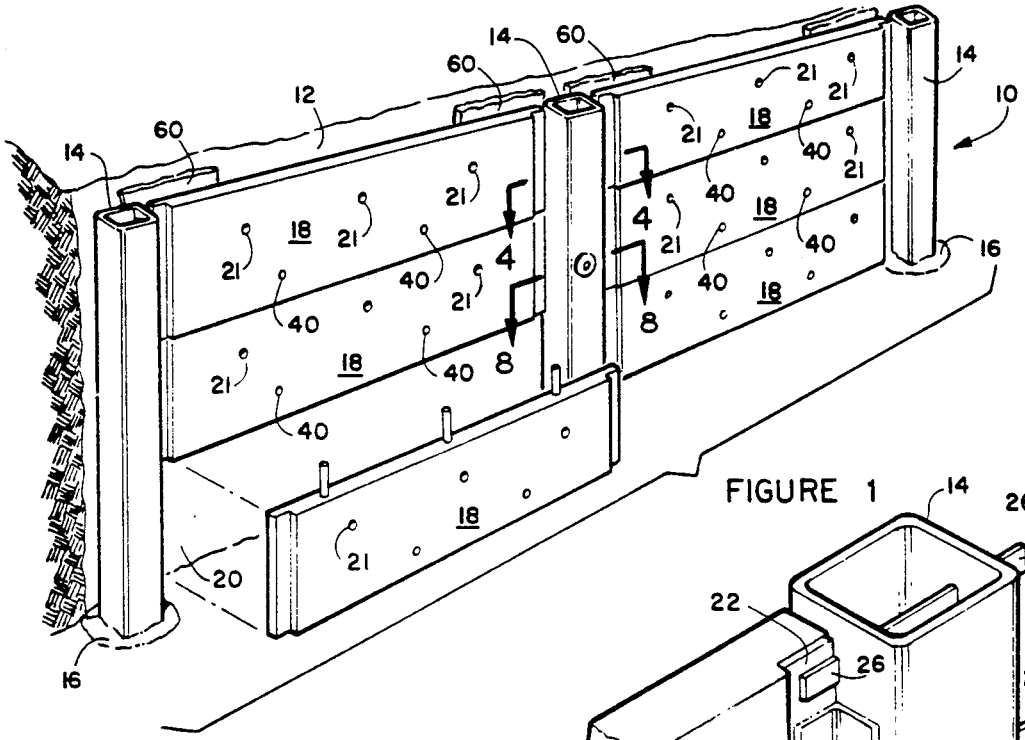
FIG. 1 is a perspective view showing a partially completed wall built by the method of this invention.

Referring now to FIG. 1, there is seen a simplified, schematic perspective view showing partial installation of a wall 10 within an excavation 12 in the earth. A plurality of soilpier beams 14 have been installed in bores 16, as is detailed below. Soilpier or soldier beams 14 are substantially parallel and will ordinarily be substantially vertical, although the wall could be constructed at a slant, if desired. Panels 18 are installed between soilpier beams 16 and are secured to soilpier beams 16 as discussed below. The space between soilpier beams and the bore wall is filled with concrete, as is described in detail below.

While panels 18 may have any suitable dimensions, preferably they have lengths of from about 8 to 20 feet, heights of from about 4 to 8 feet and thicknesses of from about 4.5 to 12 inches. While panels 18 may be formed from any suitable material, pre-formed reinforced concrete panels are preferred for strength, economical manufacture, ease of handling and long life in use.

Basically, panels 18 are progressively installed from the surface of the earth down to the full depth of the intended excavation. Initially, the bores 16 are drilled and soilpier beams 14 are installed therein. The interior of excavation 12 is excavated to the depth of one panel, or a little more. Concrete around the soilpier beam is at least partially chipped away to remove the lean concrete from at least the sides of the soilpier beams. Concrete is preferably also chipped away from the inward side for appearance, while leaving the concrete at the back as a reinforcement against the excavation side. The uppermost panel 18 is then secured to the adjacent soilpier beams 14 and any desired grouting between panel and the excavation wall and between panel and soilpier beam is accomplished. Then the excavation is deepened and the next row of panels 18 is installed. As seen in FIG. 1, two rows of panels 18 have been installed and a third row is ready for installation at the position shown by broken lines 20.

A plurality of holes 21 are provided through panels 18 through which concrete grout may be pumped to fill the space between the panels and the inner wall of excavation 12, as detailed below.

Figure 2:
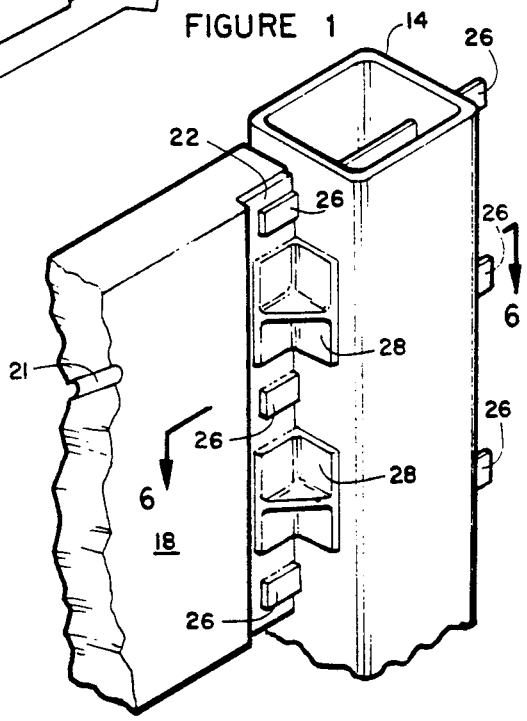
FIG. 2 is a detail perspective view showing the panel to soilpier beam attachment system.
Figure 6:
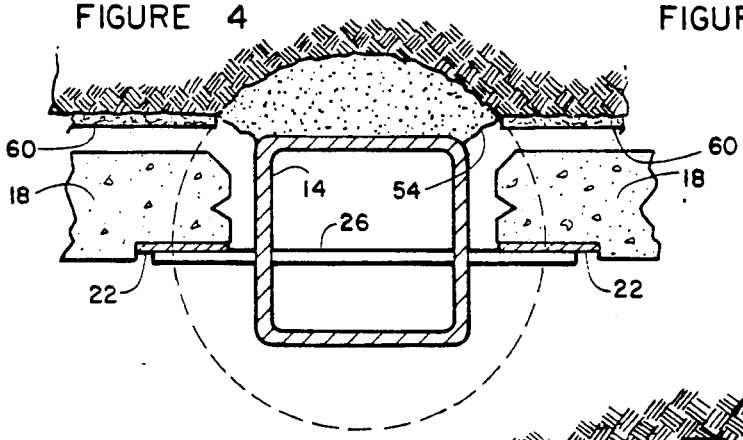
FIG. 6 is a horizontal section view taken on line 4—4 in FIG. 1 showing panels emplaced adjacent to the soilpier beam.

FIG. 2 is a schematic perspective illustration of a preferred method for fastening soilpier beams 14 to panels 18. A metal strip 22 is secured to each inward or first face adjacent to the edge of each panel 18 in a recess. Strips 22 may be secured by any suitable means, such as conventional "rebar" reinforcing rods (not shown) welded to the strip and embedded in the concrete of panel 18 during panel manufacture. A plurality of seismic or earthquake resistant ties 26 (which extend through beams 14 as best seen in FIG. 6) are welded to strips 22 after the panel is put in the desired location and held at the proper, even, distance from the adjacent soilpier beams 14.

Brackets 26 are welded to soilpier beams 14 and to strips 22. Whatever means was holding the panel 18 in place, such as a conventional crane (not shown) can then be released and moved to install the next panel.

Figure 3:
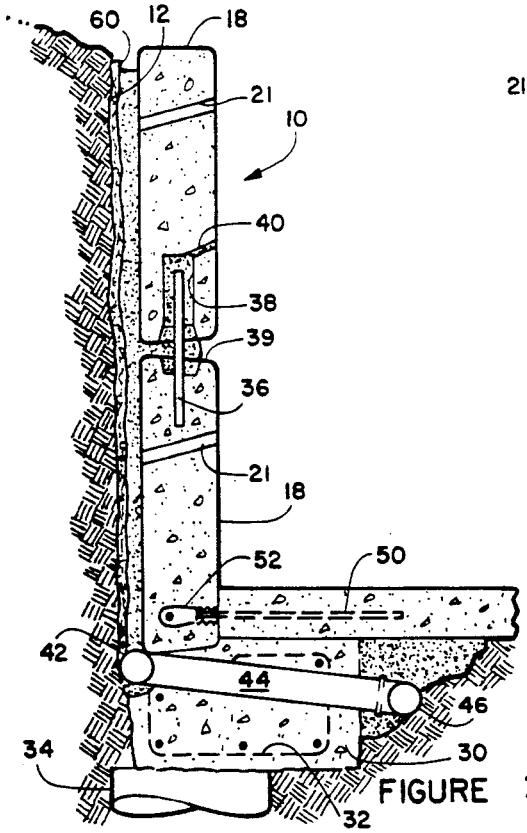
FIG. 3 is a vertical section view through the lower portion of a completed wall, taken perpendicular to the wall.
Figure 4:
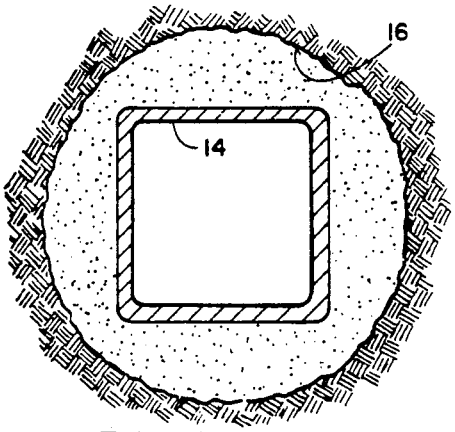
FIG. 4 is a horizontal section view taken on line 4—4 in FIG. 1 showing the soilpier beam installed in the bore and surrounded by concrete.

FIG. 3 is a schematic section view, taken perpendicular to the wall 10, showing the lowermost panels in a completed wall. When the lowest panel 18 has been installed and fastened to its adjacent soilpier beams, a conventional footing 30, containing conventional reinforcement 32, will generally be formed around the perimeter. Footing 30 will engage the lowest portion 34 of the concrete that filled the bore around soilpier beams 14.

Caulking may then be pumped into the space between a panel 18 and the wall of the excavation behind the panel, as detailed below.

In order to lock adjacent panels 18 together, a plurality of rods 36 are embedded in the upper edges of each panel 18, at locations corresponding to recess 38 preformed in the lower panel edges. When the lower panel is installed, it is brought upwardly so that rods 36 enter recesses 38. A tube 40 extends from recess 38 to the face of panel to allow concrete grout to be introduced to fill recess 38 and fill the space 39 between adjacent panels. A liner 60 is placed over the surface of excavation 12 as seen in FIG. 3. Liner 60 is a fabric that acts as a vertical water collector, directing water in the soil adjacent to the excavation to pipe 42. A drain system includes pipes 42 having perforations along the lower sides, typically embedded in gravel, running along the exterior of footings 30. Connecting pipes 44 periodically extend through footings 30 to collect pipes 42 to an interior water removal pipe 46 leading to a conventional sump pump or the like (not shown).

Conventional concrete flooring 48 may be installed, with reinforcements 50 threaded into fittings 52 installed in the lowermost panel 18 during panel fabrication.

The sequence of panel installation relative to soilpier beams 14 is schematically illustrated in FIGS. 4–8, which are horizontal detail section views through a soilpier beam and adjacent panels.

Once bore 16 has been formed, such as by conventional drilling, soilpier beam 14 is installed and carefully positioned. Normal concrete is then pumped in to a level sufficient to form lower portion 34 as seen in FIG. 3. Then a "lean", weaker concrete mix 54 is pumped in to fill the space between soilpier beam and bore. Any conventional coating or wrapping may be used around soilpier beams 14 to improve adhesion to the concrete and to prevent corrosion of the metal soilpier beam by chemicals in the concrete or ground water.

Figure 5:
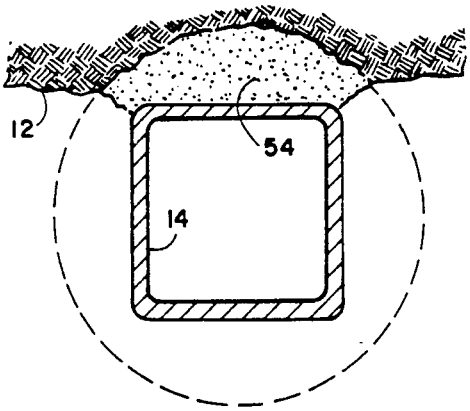
FIG. 5 is a horizontal section view taken on line 4—4 in FIG. 1 showing the soilpier beam with the earth excavated to the depth of one panel and concrete partially removed form the soilpier beam.

When the excavation has been excavated to a depth corresponding to one panel, the earth is removed from between the soilpier beams 14 and the lean concrete 54 is chipped away from the front and sides of soilpier beam 14, as seen in FIG. 5. Broken line 56 schematically indicates the perimeter of the original bore 16. Concrete 54 below the excavated depth and at the back of soilpier beam 14 remains to solidly hold the soilpier beams in alignment with each other.

Next, as seen in FIG. 6, panels 18 are positioned adjacent to, but spaced from, soilpier beams 14. Ties 26 are secured to strips 22 such as by welding. Any suitable means may be used to hold each panel in the desired position during welding the brackets 28 to strips 22. Ties 26 may be added before or after welding brackets 28 to strips 22.

Figure 7:
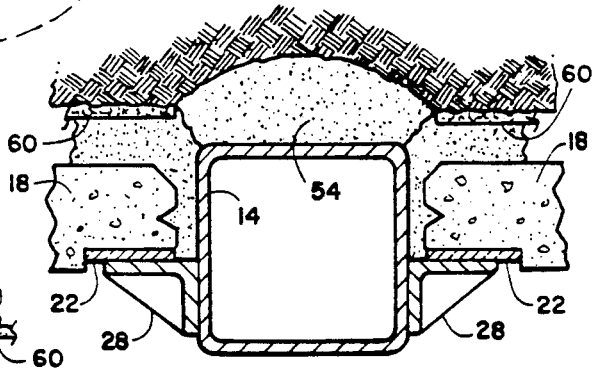
FIG. 7 is a horizontal section view taken on line 4—4 in FIG. 1 showing brackets welded to soilpier beam and panel and the grouting completed.
Figure 9:
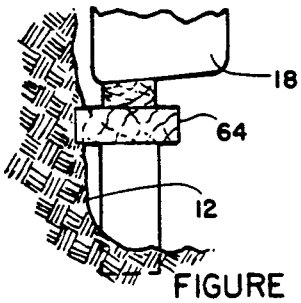
FIG. 9 is a detail section view taken on line 9—9 in FIG. 1 showing an arrangement for limiting grout flow.

As shown in FIG. 7, the angle brackets 28 are welded to strips 22 and soilpier beams 14 and concrete grout 58 is poured or pumped into the space between panes 18 and the interior wall of excavation 12 and between soilpier beams 14 and the ends of panels 18. Conventional water sealing coverings may applied all around each panel 18 prior to installation of the panel. Suitable conventional means for limiting grout flow may be used. As seen in FIG. 9, if each panel is to be individually grouted before the entire wall is finished, wooden planks 64 may be held along the lower edge of panels 18 to seal the space between excavation 12 and the panels during grouting. Similarly, other openings, such as those between the soilpier beams and panels not covered by ties 26 and brackets 28 (FIG. 2) may be sealed. A coating or liner may be placed over the surfaces of soilpier beams 14 and panels 18 in contact with the grout to waterproof those surfaces. The panels are now solidly locked in place.

Figure 8:
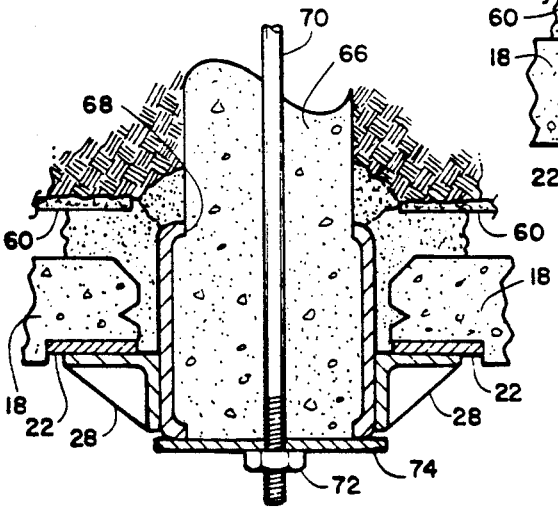
FIG. 8 is a horizontal section view taken on line 8—8 in FIG. 1 showing the installation of a central reinforcement.

In order to further strengthen the wall, it is preferred that a tie-back beam 66 extending into the wall of excavation 12 be placed at selected locations. Tie-back beam 66 typically has a length of about 30 to 60 feet. As seen in FIG. 8, each tie-back beam 66 extends through a hole 68 in a soilpier beam 14. A threaded rod 70 is secured within tie-back beam 66 and serves to pre-stress the tie-back beam by means of a conventional hydraulic jack. Then a lock-off nut 72 is secured over plate 74 to a suitable tension, typically about 100,000 pounds.

Other applications, variations and ramifications of this invention will occur to those skilled in the art upon reading this disclosure. Those are intended to be included within the scope of this invention, as defined in the appended claims.

I claim:

1. A method for constructing a below-ground wall which comprises the steps of:

boring a plurality of spaced, substantially parallel, holes in the earth;

installing a plurality of substantially parallel soilpier beams in said holes;

excavating earth from between adjacent soilpier beams and on a first side of the row of soilpier beams to a selected depth;

securing structural panels to adjacent soilpier beams;

said panels having heights approximately equal to said selected depth;

at least one additional time further excavating earth from between adjacent soilpier beams and on said first side of the row of soilpier beams to an additional selected depth and securing structural panels between said adjacent soilpier beams below the preceding panel secured to those soilpier beams;

providing at least one upstanding rod extending above the upper edge of each panel below the uppermost panel;

providing a cooperating recess in the lower edge of each panel above the lowermost panel;

providing an opening into said recess from the face of said panel on said first side of said panel;

inserting said rod into said recess as each next lower panel is installed; and filling said recess with cementous material through said opening.

2. The method according to claim 1 wherein said soilpier beams are installed in said holes by filling said holes around said soilpier beams with concrete.

3. The method according to claim 2 wherein:

said concrete below the lowermost intended panel is normal concrete and said concrete along portions of the soilpier beams to which panels are to be secured is lean concrete; and including the further step after each excavation step and prior to securing said panel to said soilpier beams chipping away said lean concrete on at least the sides of said soilpier beams 4. The method according to claim 1 including the further step of:

providing a plurality of holes through each panel from face to face; and directing group through said holes to fill the space between the panel and the adjacent unexcavated earth.

5. The method according to claim 4 including the further step of placing a liner of fabric at selected locations over the surface of said adjacent unexcavated earth prior to the introduction of said grout to act as a vertical water collector.

6. The method according to claim 1 further including:

forming at least one approximately horizontal opening through at least one soilpier beam;

forming a bore into the unexcavated earth extending from said opening;

forming a concrete tie-back beam in said opening and said bore;

providing a plate over said opening;

said tie-back beam including a threaded rod extending from said tie-back beam toward said first side through an opening in said plate;

tightening said threaded rod against said plate to compression stress said tie-back beam.

7. The method according to claim 1 further including the step of forming a footing at the bottom of said wall after installation of the final panel.

8. A wall constructed according to the method of claim 1 boring a plurality of spaced, substantially parallel, holes in the earth;

installing a plurality of substantially parallel soilpier beams in said holes;

excavating earth from between adjacent soilpier beams and on a first side of the row of soilpier beams to a selected depth;

securing structural panels to adjacent soilpier beams;

said panels having heights approximately equal to said selected depth;

at least one additional time further excavating earth from between adjacent soilpier beams and on said first side of the row of soilpier beams to an additional selected depth and securing structural panels between said adjacent soilpier beams below the preceding panel secured to those soilpier beams.

9. A method for constructing a below-ground wall which comprises the steps of:

boring a plurality of spaced, substantially parallel, holes in the earth;

installing a plurality of substantially parallel soilpier beams in said holes, excavating earth from between adjacent soilpier beams and on a first side of the row of soilpier beams to a selected depth;

securing structural panels to adjacent soilpier beams;

said panels having heights approximately equal to said selected depth;

at least one additional time further excavating earth from between adjacent soilpier beams and on said first side of the row of soilpier beams to an additional selected depth and securing structural panels between said adjacent soilpier beams below the preceding panel secured to those soilpier beams;

said soilpier beams have a metal exterior;

said panels comprise reinforced concrete with metal strips secured to the face of said panel on said first side, adjacent to said soilpier beams; and securing said panels to said soilpier beams by welding brackets between said adjacent strips and soilpier beams.

10. A method of constructing a below-ground wall which comprises the steps of:

boring a plurality of spaced, substantially parallel, holes in the earth;

installing a plurality of substantially parallel soilpier beams having a metal outer surface in said holes;

filling the holes around said soilpier beams with concrete;

excavating earth from between adjacent soilpier beams and on a first side of the row of soilpier beams to a selected depth;

chipping away concrete on at least the sides of said soilpier beams facing toward the adjacent soilpier beams;

providing a plurality of structural panels sized to fit between adjacent soilpier beams within said selected depth;

providing each of said panels with a metal strip secured thereto along the edge of the face on said first side;

securing said panels to adjacent soilpier beams by welding brackets between said soilpier beams and said strips;

at least one additional time further excavating earth from between adjacent soilpier beams and on said first side of the row of soilpier beams to an additional selected depth and securing structural panels between said adjacent soilpier beams below the preceding panel secured to those soilpier beams.

11. The method according to claim 10 wherein:

said concrete below the lowermost intended panel is normal concrete and said concrete along portions of the soilpier beams to which panels are to be secured is lean concrete; and including the further step after each excavation step and prior to securing said panel to said soilpier beams chipping away said lean concrete on at least the sides of said soilpier beams abutting said panel.

12. The method according to claim 10 including the further step of:

providing a plurality of holes through each panel from face to face; and directing grout through said holes to fill the space between the panel and the adjacent unexcavated earth.

13. The method according to claim 12 including the further step of placing a fabric liner at selected locations over the surface of said adjacent unexcavated earth prior to the introduction of said grout to act as a vertical water collector.

14. The method according to claim 10 further including:

providing at least one upstanding rod extending above the upper edge of each panel below the uppermost panel;

providing a cooperating recess in the lower edge of each panel above the lowermost panel;

providing an opening into said recess from the face of said panel on said first side;

inserting said rod into said recess as each next lower panel is installed; and filling said recess with grout through said opening.

15. The method according to claim 10 further including:

forming at least one approximately horizontal opening through at least one soilpier beam;

forming a bore into the unexcavated earth extending from said opening;

forming a concrete tie-back beam in said opening and said bore;

providing a plate over said opening;

said tie-back beam including a threaded rod extending from said tie-back beam toward said first side through an opening in said plate;

tightening said threaded rod against said plate to compression stress said tie-back beam.

16. The method according to claim 10 further including the step of forming a footing at the bottom of said wall after installation of the final panel.

17. A wall constructed according to the method of claim 10 boring a plurality of spaced, substantially parallel, holes in the earth;

installing a plurality of substantially parallel soilpier beams having a metal outer surface in said holes;

filling the holes around said soilpier beams with concrete;

excavating earth from between adjacent soilpier beams and on a first side of the row of soilpier beams to a selected depth;

chipping away concrete on at least the sides of said soilpier beams facing toward the adjacent soilpier beams;

providing a plurality of structural panels sized to fit between adjacent soilpier beams within said selected depth;

providing each of said panels with a metal strip secured thereto along the edge of the face on said first side;

securing said panels to adjacent soilpier beams by welding brackets between said soilpier beams and said strips;

at least one additional time further excavating earth from between adjacent soilpier beams and on said first side of the row of soilpier beams to an additional selected depth and securing structural panels between said adjacent soilpier beams below the preceding panel secured to those soilpier beams.

* * * * *